United States Patent [19]

Tadashi et al.

[11] Patent Number: 4,517,018

[45] Date of Patent: May 14, 1985

[54] CAST IRON ALLOY AND METHOD FOR PRODUCING SAME

[75] Inventors: Ii Tadashi, Okayama; Egusa Saichi, Hiroshima, both of Japan

[73] Assignees: Kabushikigaisha Kyowa Chuzosho, Okayama; Yugengaisha Kyowa Chuzosho, Hiroshima; Otsuka Chemical Co., Ltd., Osaka; Ando Parachemie Co., Ltd., Tokyo, all of Japan

[21] Appl. No.: 470,459

[22] Filed: Feb. 28, 1983

[30] Foreign Application Priority Data

Feb. 27, 1982 [JP] Japan ..... 57-31456

[51] Int. Cl.[3] ..... C22C 33/08

[52] U.S. Cl. ..... 75/129; 75/130 R

[58] Field of Search ..... 75/129, 130 R

[56] References Cited

U.S. PATENT DOCUMENTS 3,695,946 10/1972 Demeaux ..... 75/129

4,035,183 7/1977 Okamoto ..... 75/129

*Primary Examiner*—Peter D. Rosenberg

*Attorney, Agent, or Firm*—Koda and Androlia

[57] ABSTRACT

A composite cast iron alloy used as a material for non-ferrous metal casting equipment. The raw materials for the composite cast iron alloy include iron, calcium-containing substances, coke, titanium compounds, silica, compounds containing graphite stabilizing elements and aluminum metal. The raw material for the iron is pig iron, scrap and steel and the titanium compounds are either alkaline metal titanates or alkaline earth metal titanates. The composite cast iron alloy is produced by first melting and reacting the iron raw material with calcium containing substances, coke and titanium compounds to obtain melted iron material for casting, mixing the melted iron material for casting with aluminum metal and casting the mixture into a composite alloy.

15 Claims, No Drawings

CAST IRON ALLOY AND METHOD FOR PRODUCING SAME

BACKGROUND OF THE INVENTION

1. Field of the Invention

The present invention relates to composite cast iron alloys and particularly to composite cast iron alloys that are made from melted cast iron and melted aluminum.

2. Prior Art

Conventionally, the most common material for low pressure casting equipment for aluminum or aluminum alloy is Ferric Cast Iron (FC) 20–25. As a consequence, in the melt of the aluminum alloy, etc., impurities such as carbon and iron components which are derived from the FC cast iron are mixed in, resulting in lower quality of the casting products of aluminum alloy.

The degradation in product quality mentioned above is not merely due to the mixing of the FC 20–25 cast iron into the melt of the aluminum alloy, etc., but other reasons such as corrosion by electric current also account for some of it. Such a current is generated by an electrochemical reaction taking place due to the creation of a local battery. Accordingly, as a preventive measure, coating or lining over the surface of the crucibles or stalks with various types of highy anticorrosive materials have been attempted. However, a material with a satisfactory effect has not been found as yet. For example, for durability alone, a coating of silicon carbide of silicon nitride or the formation of a ceramic layer by flame spray among other methods, will accomplish this purpose. However, these coated layers are unable to maintain their normal hot strength because of the mixing of fluorides and chlorides used as a slag remover in the aluminum melt. Hence, at the present stage, these measures have not resulted in the effect expected.

In search of a means to prevent the melting out and the corrosion of crucibles and stalks, inventors took note of metallic titanium and found out that a satisfactory result can be obtained for stalks by insertion casting with metallic titanium pipes. Such a proposal is the basis for Japanese Patent Application No. 1981-112656. Metallic titanium is high in wear resistance, corrosion resistance as well as heat resistance. In addition, even if it is fused into the aluminum melt, it brings about a refining effect on the crystal grain of the aluminum alloy. Therefore, an improvement in mechanical as well as physical properties of the aluminum metal alloy can be expected. In fact, such effect was actually obtained, thus ensuring the desirability of the metallic titanium. Also, the service life of the stalk was increased to nearly thirty days which is twice as long as a stalk using ordinary FC cast iron as the material since its service life is not more than fourteen days.

Nevertheless, observation of the conditions of the stalk made by insert casting with metallic titanium after its use revealed the following fact. That is, instead of the wear of the metallic titanium plate itself being the greater problem, corrosion due to the exposed surface of the FC cast iron due to breakage in the lining layer caused the greater damage. This fact indicates that the corrosion caused by the separation of the titanium lining layer is a serious factor. The reason for the breakage is assumed to be the hysteresis expansion caused by the large growth phenomenon of ordinary cast iron during the heating and cooling processes. Consequently, the inventors came to conclude that unless this hysteresis expansion is prevented, sufficient improvement in the product by means of insertion casting with titanium metal cannot be obtained.

In an attempt to solve the corrosion problem, the inventors continued their pursuit for a solution be selecting various cast iron alloys and by casting stalks from conventionally known cast iron alloys such as high aluminum cast iron, Al-Si system Alsiron cast iron and Cralfer cast iron that is obtained by adding Cr to the former. The actual operation test conducted on stalks obtained with the above alloys showed a desirable effect for each of them in terms of performance. Also, the service life of the stalks could be extended to nearly twenty days. However, the inventors were not successful in finding an aluminum cast iron alloy having a service life longer than twenty days.

SUMMARY OF THE INVENTION

Accordingly, it is a general object of the present invention to provide an improved cast iron alloy which has the desirable characteristics without resorting to insertion casting with titanium metal plate.

In keeping with the principles of the present invention, the objects are accomplished by a composite cast iron alloy. It is obtained by first adding a titanium compound to the melted iron material during the production of the cast iron and then mixing the cast iron with the titanium compound with an aluminum melt.

It is another object of the present invention to stabilize the graphite in the cast iron and increase the durability. To achieve these results, other elements are added to the composite cast iron alloy. These additional elements are the addition of large amount of silica and compounds containing elements effective to stabilize the graphite of the cast iron, particularly in addition to the alkaline metal titanate. The composite cast iron alloy thus obtained shows further improved durability. Accordingly, with such composite cast iron alloys, the purpose of obtaining a desirable material for light alloy casting equipment has been achieved.

DETAILED DESCRIPTION OF THE INVENTION

The composite cast iron alloy can be produced using a method or process described below. In particular, the raw materials for the iron which consists of pig iron, scrap, steel and other raw materials including limestone, coke, silica, alkaline metal titanate, plus compounds containing the black lead stabilizing elements are melted and let to react in a cupola. The melted iron material for cast iron obtained from the above is mixed into an aluminum melt to obtain the cast iron form of the composite alloy.

The aluminum content in the composite cast iron alloy is set to be 0.1 to 10 percent by weight (hereinafter indicated merely by %), with a preferable range of 1 to 8%. The aluminum is an element with strong action in accelerating graphitization and it facilitates the graphitization of the cast iron.

The titanium component is derived from a titanium compound and the content is set at 0.1 to 20%, preferably 0.1 to 5%. Few actual examples are known for a titanium alloy cast iron, but in the present invention, the titanium shows a remarkable desirable effect for the following reasons. That is, metallic titanium is 4.54 in specific gravity, 1668° C. in melting point, 3537° C. in boiling point, has a high heat resistance and is a light weight and strong metal. Therefore, it adds high heat resistance and corrosion resistance to melts of light alloys such as aluminum alloy. In particular, when the titanium metal is added in the form of an alkaline metal titanate or alkaline earth metal titanate, a homogeneous dispersion in matrix form is achieved. Accordingly, the addition in such a form is preferable.

The mixing of the titanium into the composite alloy may be done when metallic titanium. However, the better result can be obtained with the titanium is introduced in the form of titanium compound. Particularly, mixing in the form of an alkaline metal titanate or alkaline earth metal titanate is most desirable. Titanium oxide ($TiO_2$), titanic acid ($Ti(OH)_4$), metatitanic acid ($TiO(OH)_2$), titanic iron ore (ilmenite) ($FeTiO_3$), etc. are useful examples.

Alkaline metal titanates includes lithium titanate ($Li_2TiO_3$), sodium titanate ($Na_2TiO_3$) and potassium titanate ($K_2TiO_3$). A remarkably desirable cast iron in terms of corrosion resistance against the aluminum melt is obtained when the alkaline metal titanates are added in the form of potassium titanate whisker (a fine single crystal fiber with chemical structure of $K_2O.6TiO_2$). A similar improvement in the properties were confirmed by the addition of alkaline earth metal titanates, such as magnesium titanate, barium titanate and calcium titanate.

In the same manner as the alkaline metal component which will be mentioned later, a calcium component (calcium-containing substance), is effective for bringing about a substantial improvement in corrosion resistance of the composite cast iron alloy. The calcium component is derived from limestone and lime. The range of the content of calcium is 0.0001 to 0.1%. When the content exceeds this range, the composite cast iron alloy obtained becomes brittle and it seems to be ineffective in actual use.

The alkaline metal component is, as will be mentioned later in the description of the method of production, composed primarily of lithium, potassium and sodium which are derived from the alkaline metal titanates. In the present invention, a particularly effective dispersive fusion into the composite cast iron alloy is shown when the alkaline metal component is poured into the cupola in the form of a potassium titanate whisker (a fine single crystal fiber of potassium titanate), together with the raw material for the cast iron. As the range for the content of the alkaline metal component, 0.001 to 1.0% is desirable.

The carbon component is obtained from the raw material for the irons, such as pig iron, scrap, steel and coke. The amount of the carbon component is 1.5 to 3.0% and is similar to the content in ordinary cast iron.

The silica component is 4 to 8% and is considerably higher than its normal content in ordinary cast iron.

The other component characteristic of the present invention is a compound containing the graphite stabilizing element. By the addition of this component, the characteristic properties of the composite cast iron alloy described above are further improved. As the graphite stabilizing elements, manganese, chromium, nickel, molybedenim, etc. are widely known to be effective. Also, it is a well known fact that these elements are contained in a certain amount in ordinary FC cast iron. However, the following information was obtained from creation of the present invention. That is, by adding these metallic elements positively and in a large amount into the composite cast iron alloy containing alkaline metal titanate, the heat resistance and the corrosion resistance against the melts of light alloys, such as aluminum alloy, are further enhanced.

Compounds containing graphite stabilizing elements such as used in the present invention are ferromanganese, ferrochromium, ferronickel, ferromolybdenum, etc. Either type of these compounds or the mixture of two or more types of the compounds is poured into the cupola together with the other respective materials to be melted and let react to obtain the melted iron material for the casting. The amount of the compound containing the graphite stabilizing elements in the composite cast iron alloy is in the range of 0.02 to 8% of the final product. The preferable range in light of performance and economical efficiency is 0.2 to 3%. It was found that with an increase in the content, both the heat resistance and corrosion resistance are improved.

The composite alloy cast iron according to the present invention can be produced by the following process. Together with the raw materials for the iron, such as pig iron, scrap, steel, limestone, coke, silica, lime, alkaline metal titanate and, if necessary, the compounds containing the graphite graphite stabilizing elements are poured into the cupola wherein these materials are melted and left to react into the melted iron material for casting. The melting temperature is 1500° to 1600° C. and the tapping temperature is 1450° to 1500° C. The melt taken out from the melting equipment to be mixed into the aluminum melt utilizing a foundry ladle. The pouring temperature for the melt thus obtained, 1400° to 1500° C. is preferable. The pouring temperature for remelting of the ingot may be 1350° to 1450° C. which is 50° C. than the pouring temperature.

The structure for the composite cast iron alloy according to the present invention has not yet been fully clarified. However, according to the findings obtained by means of photographs from a X-ray microanalyzer, the elements including aluminum, titanium, calcium, potassium, manganese, chromium, nickel, molybdenum, carbon, silica are completely dispersed into the structure forming a desirable matrix with dispersive fusion. An analysis of these elements was done by element ion micronaalysis (IMA) and by electronics spectrum analysis (ESCA). The composite cast iron alloy having the above described composition was made into stalks for low pressure casting of aluminum and the durability was tested. The result showed that the stalks thus obtained suffered absolutely no corrosion and maintained their original form upon casting while being used for 57 days total. This means that unprecedently long durability was achieved. When compared with the durability of six days shon by ordinary FC cast iron and 14 days shown by composite cast iron alloy containing graphite stabilizing element, the anticorrosive durability shown by the composite cast iron alloy according to the present invention is almost ten times that of the former and more than four times that of the latter. As a result, it became apparent that this composite cast iron alloy is extremely excellent as the cast iron raw material for light alloy casting equipment.

Hereunder, the further specific description will be given of the composition as well as the effect of the present invention with reference to the actual examples.

EXAMPLE 1

A composition ratio upon pouring into a cupola was obtained as follows: 50 parts FC scrap, 50 parts steel, 13 parts coke, 30 parts lime and 20 parts silica. Also, into the above, 5 parts of potassium titanate whisker (brand name Tismo L, produced by Otsuka Kagaku Yakuhin Co., Ltd. Japan), 60 parts of quick lime, 2 parts of bentonite and 1 part of graphite powder were added after kneading them with water and forming them into lumps and drying.

The condition for melting in the cupola was exactly the same as those for ordinary FC cast iron and the melting could be effected simply by compounding the materials in accordance with the method described above. For the addition of the remaining component, i.e., aluminum, pure aluminum was added in an amount of 5% into the melt in the receiver.

The chemical composition of the composite cast iron alloy obtained was as follows: 1.01% aluminum, 0.159% titanium, 0.001% calcium, 0.01% potassium, 2.47% carbon and 4.44% silica.

By using the composite cast iron alloy thus obtained, stalks for low pressure casting equipment for aluminum were made. Two of these stalks were 5.66 kg in total. Also, conventionally known FC stalks were made. These FC stalks were 60 kg for the two of them. The respective stalks were set in low pressure casting equipment. Then, by actually running the equipment, a continuous operation test of the heat resistance, durability and corrosion resistance was conducted on the stalks made by using the composite cast iron alloy according to the present invention and stalks made by using FC cast iron. The test results are as follows. The stalks made by using the composite cast iron alloy according to the teachings of the present invention showed no change in appearance even after 24 days of continuous operation. Furthermore, even after an additional seven days of operation, they stayed unchanged with no loss of weight (see Photograph 1). On the other hand, FC stalks underwent severe corrosion by continuously running for six days and showed a 12 kg loss in weight for the two of them. As a result, operation became impossible using these stalks and new stalks had to be used instead (see Photograph 2).

EXAMPLES 2 THROUGH 6, EXAMPLES FOR COMPARISON 1 THROUGH 3

The compounding ratio for pouring into the cupola was as follows: as component A, 30 parts of FC scrap, 20 parts of FC pig iron, 50 parts of steel, 13 parts of coke, 30 parts of lime and 10 parts of silica; as component B, 2 parts of ferromanganese, 2 parts of ferrochromium; and as component C, 5 parts of potassium titanate whisker (brand name Tismo D, produced by Otsuka Kagaku Yakuhin Co., Ltd. Japan), 10 parts of lime, 5 parts of bentonite and 0.1 parts of black lead powder. The component C was added after kneading the respective materials with water and forming them into charcoal colored ball-like lumps with 40 mm square surfaces and with a center thickness of 30 mm and then drying them.

The conditions for melting in the cupola were similar to those for ordinary FC cast iron. The measured melting temperature was about 1550° C and the measuring tapping temperature was 1480° C.

The remaining component D, i.e., aluminum, was added in the form of pure aluminum in an amount of 5% into the melt in the receiver of the cupola.

The chemical composition of the composite cast iron alloy obtained was 2.52% aluminum, 0.14% titanium, 0.04% calcium, 0.001% potassium, 1.01% manganese, 0.67% chrominum, 2.71% carbon and 3.87% silica. The physical properties are shown in Table 1.

In accordance with the method described above, stalks were made using the composite cast iron alloy composed of the respective components listed in Table 1. The stalks thus obtained were set in actual equipment for low pressure casting of aluminum and the heat resistance, durability and corrosion resistance were tested. The results are shown in Table 1.

TABLE 1

| | Composition ratio (by part) | | | | Physical property | | | | Actual running test for stalk (days in total) |
|---|---|---|---|---|---|---|---|---|---|
| Sample | Component A | Component B | Component C | Component D | Deflective strength (kg/mm$^2$) | Deflection | Tensile strength (kg/mm$^2$) | Hardness | |
| Example 2 | Fe (Composition ratio as in text | FeMn2 FeCr2 | K2TiO3 (Composition ratio as in text | Al (Composition ratio as in text | 1,000 | 5.4 | 22.5 | 187 | More than 57 days. No change in appearance. Almost no loss in weight |
| Example 3 | Same as above | FeMn2 FeCrl FeNil | Same as above | Same as above | 990 | 5.8 | 23.5 | 179 | Same as above |
| Example 4 | Same as above | FeMnl FeCr2 FeMol | Same as above | Same as above | 1,000 | 5.4 | 19.8 | 175 | Same as above |
| Example 5 | Same as above | None | Same as above | Same as above | 1,100 | 4.7 | 2.6 | 207 | 14 days slightly corroded 2.5% in weight loss |
| Example 6 | Same as above | None | MgTiO3 | Same as above | 1,020 | 4.4 | 3.5 | 195 | Same as above |
| Example for Comparison 1 | Same as above | None | None | Same as above | 790 corroded. | 4.0 | 24.0 | 230 | 8 days considerably corro- 8.5% in weight loss |

TABLE 1-continued

| Sample | Composition ratio (by part) Component A | Component B | Component C | Component D | Physical property Deflective strength (kg/mm²) | Deflection | Tensile strength (kg/mm²) | Hardness | Actual running test for stalk (days in total) |
|---|---|---|---|---|---|---|---|---|---|
| Example for Comparison 2 | Same as above | None | KsTiO3 Composition ratio same as in text | None | 510 | 3.2 | 14.0 | 160 | 8 days substantially corroded 8.5% in weight loss |
| Example for Comparison 3 | Same as above | None | None | None | 700 | 5.6 | 3.5 | 150 | 6 days no good for further use 20% in weight loss |

As should be clearly seen from the results shown in Table 1, the composite cast iron alloys (Examples 2 through 6) according to the present invention are excellent is physical properties. In addition, they are by far outstanding in the heat resistance as well as their corrosion resistance against light alloy melts (particularly aluminum).

The further desirable findings obtained about such composite cast iron alloys are that the iron content in the products of the low pressure casting of aluminum was decreased drastically and the percentage of defecting cast products was also lowered markedly. While the percentage of defects using conventional FC-20 stalks was 3.78 percent ($n=12$, $\delta=0.97$) on the average, Example 1 showed remarkable achievement in the reduction of the defective products in that it will reduce to 1.10 percent ($n=12$, $\delta=0.33$) on the average.

The comparison Example 1 is conventional aluminum cast iron without titanium, manganese and chromium. The comparison Example 2 is titanium cast iron without aluminum, manganese and chromium. The comparison Example 3 is ordinary FC cast iron.

It is apparent from Table 1 that all of these comparison examples are inferior to the examples made in accordance with the teachings of the present invention in terms of their corrosion resistance against aluminum melts.

It should be apparent to those skilled in the art that the above-described embodiments and examples are merely illustrative of but a few of the possible embodiments and examples which incorporate the principles of the present invention. Numerous and varied other arrangements can be readily devised by those skilled in the art without departing from the spirit and scope of the invention.

I claim:

1. A composite cast iron alloy produced by the process comprising the steps of:

melting and reacting iron raw material and other raw materials including calcium-containing substances, coke, and titanates;

mixing aluminum metal with the melted material obtained from the foregoing step; and casting the mixture into a composite alloy.

2. A composite cast iron alloy produced by the method of claim 1, wherein the other raw materials further comprise silica and graphite stabilizing elements.

3. A composite cast iron alloy as set forth in claim 1 or 2, wherein the titanium compounds are alkaline metal titanates.

4. A composite cast iron alloy as set forth in claim 1 or 2, wherein the titanium compounds are alkaline earth metal titanates.

5. A composite cast iron alloys as set forth in claim 3, wherein the alkaline metal titanate is the potassium titanate whisker.

6. A composite cast iron alloy as set forth in claim 4, wherein the alkaline earth metal titanate is a magnesium titanate whisker.

7. A composite cast iron alloy as set forth in claim 1 or 2, wherein the composition ratio of titanium compound is 0.1 to 20% of the composite cast iron alloy.

8. A composite cast iron aloy as set forth in claim 1 or 2, wherein the cotent of aluminum metal is 0.1 to 10%.

9. A composite cast iron alloy as set forth in claim 2, wherein the compound containing the graphite stabilizing element comprises one type or the mixture of not less than two types selected from the group consisting of ferromanganese, ferrochromium, ferronickel and ferromolybdenum.

10. A composite cast iron alloy as set forth in claim 2, wherein the compound containing the graphite stabilizing element is 0.02 to 8% in content.

11. A method for producing a composite cast iron alloy comprising the step of:

melting and reacting iron raw materials including pig iron, scrap and steel and other raw materials including limestone, coke, lime and titanate in a cupola to obtain a melted iron material for casting;

mixing the melted iron material for casting into a melt of aluminum metal; and casting the mixture into a composite alloy.

12. A method for producing the composite cast iron alloy as set forth in claim 11, wherein the titanate is in the form of potassium titanate whisker and it is added as nodules prepared by kneading it with water together with lime and clay which is formed into balls and dried.

13. A method for producing a composite cast iron alloy comprising the steps of:

reacting and melting in a cupola at 1500° to 1600° C. pig iron, scrap, steel, limestone, coke, silica, a compound containing graphite stabilizing element and potassium titanate whisker that is formed into lumps using lime and clay to obtain melted iron material for casting;

mixing at 1450° to 1500° C., the melted iron material for casting into a melt of aluminum metal at a temperature of substantially 700° C.; and casting the mixture into a composite alloy.

14. A composite cast iron alloy to be used as a material for nonferrous metal casting equipment that is made by melting and reacting iron raw materials and other raw materials including a calcium-containing substance, coke and titanate to obtain a melted iron material for casting, mixing the melting iron material for casting with aluminum metal and casting the mixture into a composite alloy.

15. A composite cast iron alloy as set forth in claim 14, wherein said nonferrous metal is selected from the group consisting of pure aluminum or aluminum alloy.

* * * * *